US006655104B2

(12) United States Patent
Kadotani et al.

(10) Patent No.: US 6,655,104 B2
(45) Date of Patent: Dec. 2, 2003

(54) PC STEEL STRANDED WIRE CONNECTION STRUCTURE AND CONSTRUCTION METHOD THEREOF

(75) Inventors: Tsutomu Kadotani, Atsugi (JP); Yasuo Inokuma, Shizuoka (JP); Norio Terada, Yokohama (JP); Hideaki Sakai, Toyota (JP); Toshikazu Minami, Kobe (JP); Jun Yamazaki, Yokohama (JP); Yoshitaka Nishida, Kobe (JP)

(73) Assignee: Anderson Technology Corporation, Tokyo (JP)

( * ) Notice: Subject to any disclaimer, the term of this patent is extended or adjusted under 35 U.S.C. 154(b) by 22 days.

(21) Appl. No.: 09/959,561

(22) PCT Filed: Feb. 28, 2001

(86) PCT No.: PCT/JP01/01481

§ 371 (c)(1),
(2), (4) Date: Oct. 30, 2001

(87) PCT Pub. No.: WO01/65022

PCT Pub. Date: Sep. 7, 2001

(65) Prior Publication Data

US 2002/0157333 A1 Oct. 31, 2002

(51) Int. Cl.[7] ..... B25G 3/00
(52) U.S. Cl. ..... 52/647; 52/223.13; 403/267
(58) Field of Search ..... 52/223.13, 223.14; 403/305, 374.1, 374.3, 286, 267, 269, 296, 265; 24/129 R, 130, 122.6, 136 L, 122.3

(56) References Cited

U.S. PATENT DOCUMENTS 3,559,275 A * 2/1971 Slater ..... 29/452
3,573,346 A * 4/1971 Appleby ..... 174/71 R
3,660,887 A * 5/1972 Davis ..... 264/262
4,200,768 A * 4/1980 Anhalt et al. ..... 174/79
4,752,151 A * 6/1988 Ashida et al. ..... 403/267
5,046,878 A * 9/1991 Young ..... 403/13
5,383,740 A * 1/1995 Lancelot, III ..... 403/267
5,718,090 A * 2/1998 Wei-Hwang ..... 52/223.14
6,079,895 A * 6/2000 Neighbors et al. ..... 403/305
6,176,051 B1 * 1/2001 Sorkin ..... 52/223.13

* cited by examiner

*Primary Examiner*—Carl D. Friedman
*Assistant Examiner*—Basil Katcheves
(74) *Attorney, Agent, or Firm*—Kanesaka & Takeuchi

(57) ABSTRACT

A joint made between prestressing strands with a prestressing strand coupler is covered with a transparent coupler sheath having a retarded-hardening resin filling material injection opening and discharge opening provided in a tube wall thereof, and a resin filling material is injected into the transparent coupler sheath from the injection opening to fill the coupler sheath with the filling material. Thereafter, the whole outer peripheral portion of the prestressing strand joint, including the coupler sheath, is embedded with placed concrete. Tension is applied to the prestressing strands after the concrete has hardened and before the resin filling material hardens, thereby completing an excellent prestressing strand joint structure.

According to the present invention, the filling condition of the resin filling material in the coupler sheath around the prestressing strand joint can readily be confirmed by visual observation. Therefore, the operation of filling the filling material can be carried out completely.

Further, the wedges present in the prestressing strand coupler are allowed to properly bite into the prestressing strands in response to the prestressing strand tensioning operation performed before the filling material hardens. Thus, a superior joint structure is provided.

14 Claims, 2 Drawing Sheets

PC STEEL STRANDED WIRE CONNECTION STRUCTURE AND CONSTRUCTION METHOD THEREOF

TECHNICAL FIELD OF THE INVENTION

The present invention relates to a prestressing strand joint structure for use in a prestressed concrete construction method and also relates to a method of constructing the prestressing strand joint structure.

BACKGROUND ART

A conventional prestressing strand joint is accommodated in a steel coupler sheath as it is and buried in placed concrete. The inside of the coupler sheath is filled with cement grout after the prestressing strands have been anchored under tension.

Accordingly, after the concrete has hardened, the inside of the coupler sheath cannot be seen at all. Therefore, it is impossible to check the filling condition in the coupler sheath and to repair a possible defect unless the concrete is chipped.

DISCLOSURE OF THE INVENTION

Accordingly, the present invention solves the above-described problem by providing a prestressing strand joint structure and a construction method therefor characterized in that a joint between prestressing strands is covered with a coupler sheath, particularly a transparent coupler sheath, and a resin filling material is filled in the coupler sheath.

The features of the present invention are as follows. A joint between prestressing strands, particularly pregrouted cables, is covered with a transparent coupler sheath so that a resin filling material can be filled in the coupler sheath and the filling condition can be visually checked from the outside of the coupler sheath. If there is a defect in filling, the resin filling material is injected excessively from an injection opening so that excess resin filling material is discharged from a discharge opening, thereby allowing the coupler sheath to be satisfactorily filled with the resin filling material. Alternatively, the resin filling material may be partially injected, or the coupler may be disassembled immediately to correct the operation.

That is, the present invention provides a prestressing steel stranded wire joint structure and a construction method therefor arranged as follows.

(1) A prestressing steel stranded wire joint structure includes a transparent coupler sheath for covering a joint made between prestressing steel stranded wires with a prestressing steel stranded wire coupler, the transparent coupler sheath having a resin filling material injection opening and discharge opening provided in a tube wall thereof, and a slow curing resin filling material filled in the transparent coupler sheath.

(2) In a prestressing steel stranded wire joint structure as stated in the above paragraph (1), the resin filling material is a slow curing epoxy resin.

(3) In a prestressing steel stranded wire joint structure as stated in the above paragraph (1) or (2), the resin filling material is a greasy resin having low resistance to deformation when it is in an uncured state.

(4) In a prestressing steel stranded wire joint structure as stated in the above paragraph (2) or (3), the filling material having a slow curing epoxy resin as a principal component contains a latent curing agent.

(5) In a prestressing steel stranded wire joint structure as stated in the above paragraph (2) or (3), the slow curing epoxy resin filling material contains a curing accelerator.

(6) In a prestressing steel stranded wire joint structure as stated in any of the above paragraphs (1) to (5), the prestressing steel stranded wires are pregrouted cables.

(7) A method of constructing a prestressing steel stranded wire joint, includes the steps of covering a joint between prestressing steel stranded wires with a transparent coupler sheath having a slow curing resin filling material injection opening and discharge opening provided in a tube wall thereof, the joint being made with a prestressing steel stranded wire coupler; injecting a resin filling material into the transparent coupler sheath from the injection opening to fill the transparent coupler sheath with the resin filling material; and embedding the whole outer peripheral portion of the prestressing steel stranded wire joint, including the coupler sheath, with placed concrete.

(8) A method of constructing a prestressing steel stranded wire joint, includes the steps of covering a joint between prestressing steel stranded wires with a transparent coupler sheath having a slow curing resin filling material injection opening and discharge opening provided in a tube wall thereof, the joint being made with a prestressing steel stranded wire coupler; injecting a resin filling material into the transparent coupler sheath from the injection opening to fill the transparent coupler sheath with the resin filling material; embedding the whole outer peripheral portion of the prestressing steel stranded wire joint, including the coupler sheath, with placed concrete; and applying tension to the prestressing steel stranded wires after the concrete has hardened and before the resin filling material cures.

(9) In a method of constructing a prestressing steel stranded wire joint as stated in the above paragraph (7) or (8), the resin filling material is a slow curing epoxy resin.

(10) In a method of constructing a prestressing steel stranded wire joint as stated in the above paragraph (9), the filling material having a slow curing epoxy resin as a principal component contains a latent curing agent.

(11) In a method of constructing a prestressing steel stranded wire joint as stated in the above paragraph (9) or (10), the slow curing epoxy resin filling material contains a curing accelerator.

(12) In a method of constructing a prestressing steel stranded wire joint as stated in any of the above paragraphs (7) to (11), the prestressing steel stranded wires are pregrouted cables.

EXPLANATION OF REFERENCE SYMBOLS

Figure 1:
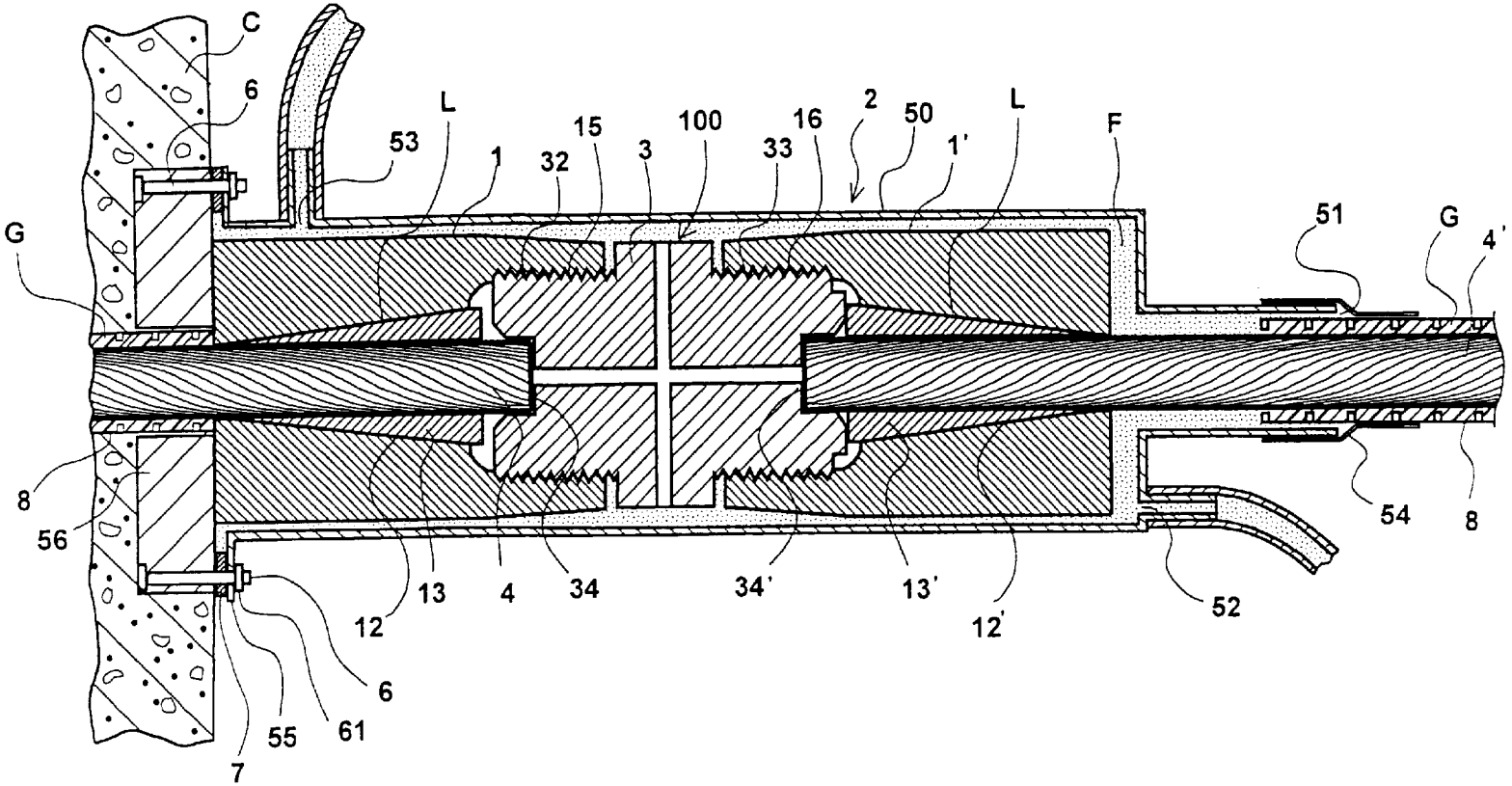
FIG. 1 is a sectional view of a prestressing strand joint structure according to an embodiment of the present invention.

Reference numerals 1 and 1' denote chuck sockets; 2 denotes a transparent coupler sheath; 3 denotes a joint member; 4 and 4' denote prestressing strands; 6 denotes bolts; 7 denotes packing; 8 denotes polyethylene sheaths; 12, 12' denote fitting portions; 13, 13' denote wedges; 15 denotes an internal thread; 16 denotes an internal thread; 32 denotes an external thread; 33 denotes an external thread; 34 and 34' denote bottom walls; 50 denotes a body portion; 51 denotes a prestressing strand insertion opening; 52 denotes a filling material injection opening; 53 denotes a filling material discharge opening; 54 denotes sealing tape; 55 denotes a flange; 56 denotes an anchor plate; 61 denotes nuts; 100 denotes a coupler; C denotes a concrete structure; F denotes a retarded-hardening resin filling material; G denotes grout; and L denotes a solid lubricant.

BEST MODE FOR CARRYING OUT THE INVENTION

Embodiments of the present invention will be described on the basis of FIGS. 1 and 2.

Figure 2:
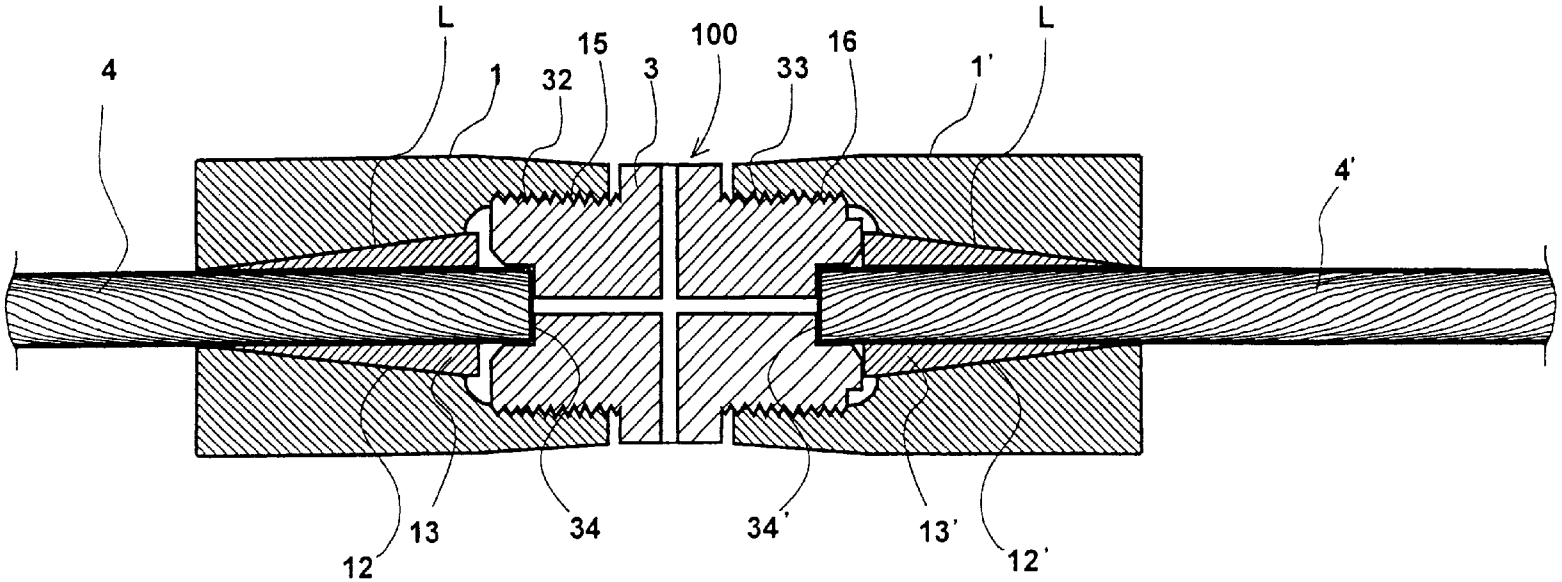
FIG. 2 is a sectional view of an embodiment of a prestressing strand coupler according to the present invention.

FIG. 1 is a sectional view showing a prestressing strand joint structure according to an embodiment of the present invention. In the figure, reference numeral 2 denotes a transparent coupler sheath in the shape of a cylinder, one end of which is closed. The transparent coupler sheath 2 has a body portion 50 with a slightly larger inner diameter than the respective outer diameters of a joint member 3 and chuck sockets 1 and 1'. The bottom of the coupler sheath 2 is provided with a prestressing strand insertion opening 51 and a filling material injection opening 52. The coupler sheath 2 further has a filling material discharge opening 53 provided in the vicinity of the top of the cylindrical portion thereof.

In addition, a flange 55 is provided around the peripheral edge of an opening portion of the coupler sheath 2 to secure the coupler sheath to an anchor plate 56 embedded in a concrete structure C.

The transparent coupler sheath 2 may be made of a material capable of withstanding the pressure of a filling material injected thereinto. It is, however, preferable to form the coupler sheath 2 from a transparent plastic material, e.g. a polyethylene resin, a polypropylene resin, or an acrylic resin, so that it is easy to check the presence of voids in the filling material filled in the coupler sheath 2

As the filling material, a retarded-hardening resin material is suitably used which does not harden for a certain period after it has been filled, i.e. which remains unhardened during the site work including the operation of joining together prestressing strands with a coupler and the prestressing strand tensioning operation but hardens to manifest rigidity after the tensioning operation.

It is possible to use an epoxy resin and also possible to use an acrylic resin, a polycarbonate resin and so forth as long as they have such properties.

Further, a resin material mixed with a filler, e.g. mineral toner, may also be used as the filling material.

As the filling material, a retarded-hardening epoxy resin is particularly preferable. It is preferable to use a retarded-hardening epoxy resin that hardens not later than the time when giving of the structure begins (usually a half year or one year after the construction).

In other words, it is preferable to use a filling material having as a principal component a retarded-hardening epoxy resin whose hardening time has been controlled so that it hardens after the tensioning operation that is performed after the concrete has hardened. The filling material contains a retarded-hardening agent that effects chemical hardening controlled to meet the above-described hardening conditions.

It is preferable that the above-described retarded-hardening agent should be at least one selected from the group consisting of dihydrazides, diphenyldiamino sulfone, dicyandiamide, imidazole and derivatives thereof, and $BF_3$ amine complex.

It is preferable to add a hardening accelerator to the above-described epoxy resin filling material.

As the above-described hardening accelerator, a tertiary amine compound is preferable.

The filling material according to the present invention is composed as stated above. Therefore, the filling material is in an unhardened fluid state when the tensioning operation is performed after the concrete has hardened. After the given time has elapsed, the filling material surely hardens.

The filling material according to the present invention basically consists of a resin material that does not harden alone at ordinary temperatures, and a retarded-hardening agent that chemically hardens the resin material. According to need, a hardening accelerator for accelerating the hardening reaction may be added to the filling material. In addition, a filler and additives may be added to the filling material.

The hardening time can be controlled by changing the kind and/or amount of retarded-hardening agent and/or hardening accelerator used.

The filling material may be a retarded-hardening composition that has as a principal component an epoxy resin which is a resin material that does not harden alone at ordinary temperatures. The composition consists essentially of an epoxy resin, a diluent, and a retarded-hardening agent and may further contain a hardening accelerator, a filler, and an additive.

Epoxy resins usable are polyepoxides having two or more epoxy functional groups per molecule. It is possible to use polyglycidyl compounds of polyhydric phenols such as 2,2-bis(4-hydroxyphenyl)propane (commonly known as "bisphenol A"), bis(4-hydroxyphenyl)methan (commonly known as "bisphenol F"), 1,1-bis(4-hydroxyphenyl)ethane (commonly known as "bisphenol AD"), 2,2-bis(3,5-dibromo-4-hydroxyphenyl)propane (commonly known as "TBA"), hydroquinone, and resorcin. Other usable resins include polyglycidyl compounds of polyhydric alcohols such as ethylene glycol and glycerin, and polyglycidyl compounds of polyhydric carboxylic acids such as phthalic acid.

As the diluent, it is possible to use general-purpose reactive diluents such as n-butylglycidyl ether, phthalates such as dioctyl phthalate, benzyl alcohol, furfuryl alcohol, and phenol-modified aromatic polymerized oils.

As the retarded-hardening agent, substances stable for a long period of time at ordinary temperatures such as those shown below are usable, for example, dihydrazides such as dihydrazide adipate and dihydrazide sebacate, diphenyldiamino sulfone, dicyandiamide, 2-methylimidazole and derivatives thereof, and $BF_3$ amine complex.

As the hardening accelerator, tertiary amines such as 2,4,6-tris(N,N-dimethylaminomethyl)phenol and N,N-benzylmethylamine are usable.

The filler is added for the purpose of controlling viscosity, thixotropic properties and the like. Calcium carbonate, talc, silica, etc. are usable as the filler.

The additive is added for the purpose of dispersing the filler and preventing precipitation of the filler.

The mixing ratio of the components constituting the above-described specific example is as follows. The mixing ratio of the epoxy resin and the retarded-hardening agent varies according to the kinds of resin and hardening agent used. Regarding a retarded-hardening agent having an active hydrogen, such as dihydrazide, the molar ratio of the retarded-hardening agent to the epoxy radical is preferably 1:0.5 to 2.0. In the case of an ionic hardening agent, e.g. $BF_3$ amine complex, or tertiary amine, the ratio of the retarded-hardening agent to the epoxy resin is preferably 0.5 to 1.0 phr (outer percentage of the component).

The amount of the hardening accelerator is preferably 0.05 to 0.5 phr. The amounts of the diluent and the filler are preferably determined in consideration of the viscosity of the composition.

When the filling material according to the present invention is used in the post-tensioning construction method, after the filling material has been filled in a transparent coupler sheath, concrete is placed around the coupler sheath. After the period of time required for the concrete to attain a predetermined strength has elapsed, tension is applied to the tendon.

It should be noted that the above-described retarded-hardening epoxy resin filling material may be a moisture reactive type epoxy resin filling material that reacts with moisture.

Conventionally, cement milk is used as a filling material. However, if cement milk hardens during the site work of the operation of applying tension to prestressing strands, the coupler is hindered from moving freely in response to the pulling force applied to the prestressing strands. In such a case, concrete cannot be prestressed.

Further, with a wedge-type coupler, the wedge teeth cannot bite into the prestressing strands.

However, these problems can be solved by employing the above-described retarded-hardening type resin filling material according to the present invention.

Further, when a pregrouted cable (i.e. a prestressing strand previously coated at its surface with an epoxy resin in a factory, the grout-coated surface being covered with a polyethylene sheath so that no void is present in the sheath) is used as each prestressing strand, the pregrouted cables are present at both ends of the coupler sheath including the cable insertion opening 51, and the gap between the polyethylene sheath 8 and each of the prestressing strands 4 and 4' is filled with grout G, e.g. a retarded-hardening type resin. Therefore, the filling material filled in the coupler sheath 2 cannot escape between the polyethylene sheath 8 and either of the prestressing strands 4 and 4'.

Next, an embodiment of a coupler for joining together prestressing strands according to the present invention will be described on the basis of FIG. 2. The coupler 100 comprises chuck sockets 1 and 1' disposed at the left and right sides, respectively, and wedges 13 and 13', together with a joint member 3 for joining together the chuck sockets 1 and 1'.

One side of the joint member 3 is formed with an external thread 32 for thread engagement with the chuck socket. The other side of the joint member 3 is formed with an external thread 33 for thread engagement with the chuck socket. The external thread 33 has an opposite thread direction relative to the external thread 32.

The chuck socket 1 (the left-hand chuck socket as viewed in the figure) has an internal thread 15 provided on the inner periphery of the distal end thereof extending toward the center of the coupler 100. The internal thread 15 is adapted to engage with the external thread 32 of the joint member 3. Thus, the chuck socket 1 is engageable with the left-hand side of the joint member 3. A fitting portion 12 is formed on the inner periphery of the rear end of the chuck socket 1. The fitting portion 12 extends from the opening in the rear end surface of the chuck socket 1 in such a manner as to form a tapered configuration. The opening is bored so that the inner diameter thereof is larger than the outer diameter of the prestressing strand 4. The chuck socket 1' (the right-hand chuck socket as viewed in the figure) has an internal thread 16 formed on the inner periphery of the distal end thereof extending toward the center of the coupler 100. The internal thread 16 is adapted to engage with the external thread 33 of the joint member 3. The internal thread 16 has an opposite thread direction relative to the internal thread 15.

The wedges 13 and 13' are each splittable into two or three pieces. The three-piece split wedge structure is preferable to the two-piece split wedge structure with a view to allowing the inner peripheral surfaces of the wedges 13 and 13' to come in close contact with the prestressing strands 4 and 4'. The three- or two-piece tapered split wedges 13 and 13' are fitted into the respective fitting portions 12 and 12' of the chuck sockets 1 and 1'. Each of the wedges 13 and 13' has a circular bore in the center thereof. The bore is slightly smaller than the outer diameter of each of the prestressing strands 4 and 4'. When fitted into the fitting portions 12 and 12', the three- or two-piece split wedges 13 and 13' clamp the prestressing strands 4 and 4' with the inner walls thereof. It is preferable that the inner walls of the wedges 13 and 13' should be formed with sawtooth grooves to offer resistance to the movement of the prestressing strands 4 and 4' in their pull-out directions. The arrangement may be such that a circumferential groove is provided on the outer periphery of each wedge, and a wire is wound along the circumferential groove to put together the wedge pieces into the desired wedge structure. With this arrangement, the wedge fitting operation is facilitated.

Next, the method of joining together the prestressing strands 4 and 4' with the prestressing strand coupler 100 arranged as stated above will be described with reference to FIG. 2.

First, in a state where the chuck sockets 1 and 1' and the joint member 3 are disengaged to such an extent that the thread engagement therebetween remains a little, the prestressing strands 4 and 4' are inserted into the chuck sockets 1 and 1' from the openings thereof. The wedges 13 and 13' are pushed in with the distal ends of the prestressing strands 4 and 4' until the end surfaces of the wedges 13 and 13' abut on the end surfaces of the joint member 3.

In this case, the inner surfaces of the fitting portions 12 and 12' of the chuck sockets 1 and 1' (and/or the outer surfaces of the wedges 13 and 13') are previously coated with a solid lubricant L, particularly preferably molybdenum disulfide ($MoS_2$) so that the wedges 13 and 13' can be readily and surely fitted into the fitting portions 12 and 12' of the chuck sockets 1 and 1' at a subsequent step. Molybdenum disulfide is a crystal with a hexagonal system, which has a laminar structure consisting of many thin layers superimposed on one another. Molybdenum disulfide has excellent adhesion to a metal surface and is chemically stable and capable of withstanding intense heat. Therefore, molybdenum disulfide is very suitable for use as a lubricant to carry out the present invention.

Consequently, the split wedges 13 and 13' move toward the joint member 3 together with the strands 4 and 4' as one unit, thereby being released from the state of being fitted into the fitting portions 12 and 12'. As a result, the inner wall of each of the wedges 13 and 13' becomes splittable to expand at the parting faces between the two or three wedge pieces. Thus, the prestressing strands 4 and 4' are allowed to pass through the wedge inner walls. The distal ends of the strands 4 and 4' pass through the inner walls to abut on the recessed bottom walls 34 and 34' of the joint member 3.

Consequently, the prestressing strands 4 and 4' are corrected to extend straight by the bottom walls 34 and 34'.

Next, with the chuck sockets 1 and 1' gripped, the joint member 3 is rotated in the direction for screwing into the chuck sockets 1 and 1', thereby forcing the external threads 32 and 33' into the chuck sockets 1 and 1' through thread engagement with the internal threads 15 and 16. Consequently, the wedges 13 and 13' are fitted into the fitting portions 12 and 12' again. This causes the expanded inner walls of the split wedges 13 and 13' to contract. The wedges 13 and 13' thus closed clamp the prestressing strands 4 and 4'. As a result, connection of the joint member 3 with the chuck sockets 1 and 1' is completed.

Further, the method of joining together the prestressing strands 4 and 4' in a state where one prestressing strand 4 is anchored to the anchor plate 56 will be described with reference to FIG. 1.

First, the prestressing strand 4 is previously inserted to extend from the inside of a concrete structure C through an anchor plate 56 on the end surface of the concrete structure C. The prestressing strand 4 projects forward from the anchor plate 56 to a distance corresponding to the length of a tensioning jack (not shown).

Next, the chuck socket 1, together with the wedge 13, is fitted onto the forward projecting portion of the prestressing strand 4. The prestressing strand 4 is pulled with a jack (not shown) having its distal end placed in close contact with the chuck socket 1 temporarily securing the prestressing strand 4, together with the wedge 13, on the surface of the anchor plate 56. With the prestressing strand 4 being pulled in this way, the wedge 13 is forced into the fitting portion 12 of the chuck socket 1. Thereafter, the pulling force from the jack is released. Thus, the prestressing strand 4 is anchored to the wedge 13 and the chuck socket 1 by the wedge action.

Thereafter, the projecting end of the prestressing strand 4 is cut off with a slight length left projecting from the end surface of the wedge 13.

Next, the prestressing strand 4', the wedge 13' and the chuck socket 1', which are shown in the right-hand part of the figure, are assembled in the same manner as described above in connection with FIG. 2.

Thereafter, the external threads 32 and 33 of the joint member 3 are brought into contact with the internal threads 15 and 16 of the chuck sockets 1 and 1'. With the chuck socket 1' gripped, the joint member 3 is rotated in the direction for screwing into the chuck sockets 1 and 1', thereby forcing the external threads 32 and 33' into the chuck sockets 1 and 1' through thread engagement with the internal threads 15 and 16.

Consequently, the wedge 13' is fitted into the fitting portion 12' again. This causes the inner wall of the split wedge 13' to contract. The wedge 13' thus closed clamps the prestressing strand 4'. As a result, connection of the joint member 3, the chuck sockets 1 and 1', the wedges 13 and 13', and the prestressing strands 4 and 4' is completed.

Next, the method of fitting the coupler sheath arranged as stated above will be described.

As shown in the above-described FIG. 1, a joint between a pair of pregrouted cables (comprising the prestressing strands 4 and 4', grout G, and sheaths 8) is covered with the transparent coupler sheath. The flange 55 of the transparent coupler sheath 2 is secured to the anchor plate 56, which has been embedded in the concrete structure C, through packing 7 by tightening bolts 6 attached to the anchor plate 56 with nuts 61. Thereafter, a putty-like sealant and sealing tape 54 are applied to close the gap between the polyethylene sheath 8 and the pregrouted cable insertion opening 51 provided in the bottom of the coupler sheath. It should be noted that each of the prestressing strands 4 and 4' is covered with the polyethylene sheath 8 except the joint portion thereof, and grout G, e.g. a retarded-hardening type epoxy resin, is filled and hardened in the polyethylene sheath 8, thereby forming a so-called "pregrouted cable".

Upon completion of the above-described preparation, a retarded-hardening resin filling material F is forced into the transparent coupler sheath through the injection opening 52 by using an appropriate filling material injection apparatus. The filling material F fills up the transparent coupler sheath 2, and excess filling material F is discharged from the discharge opening 53.

We have already conducted a confirmatory test by using a transparent coupler sheath and filling a retarded-hardening epoxy resin therein. As a result, it has been confirmed by visual observation that the filling material fills the coupler sheath substantially completely when excess filling material flows out from the discharge opening 53.

It should be noted that the retarded-hardening epoxy resin filled in the coupler sheath is in an unhardened state when tension is applied to the prestressing strands. Therefore, no adverse effect is exerted on the anchoring mechanism of the coupler.

The above-described retarded-hardening epoxy resin filling material was prepared as follows.

To 90 parts of a bisphenol A type epoxy resin (with an epoxy equivalent of 189 and a viscosity of 130 poise/25° C.; hereinafter, all viscosity values are shown by those measured at 25° C.), 10 parts of benzyl alcohol as a diluent, 7 parts of dicyandiamide as a retarded-hardening agent, 0.12 parts of 2,4,6-tris(N,N-dimethylaminomethyl) phenol as a hardening accelerator, and 50 parts of talc as a filler were added and mixed under stirring.

We examined the relationship between the hardening time and the shear adhesive strength (iron/iron) of the resin filling material under an atmosphere at 20° C. As a result, the shear adhesive strength increased rapidly about 6 months after the preparation. The shear adhesive strength after 7 months was 135 kg/cm$^2$.

Industrial Applicability

According to the present invention, the outer periphery of a joint between prestressing strands is covered with a transparent coupler sheath, and a retarded-hardening resin filling material is filled in the transparent coupler sheath. Therefore, the filling condition of the resin filling material in the coupler sheath around the prestressing strand joint can readily be confirmed by visual observation. Accordingly, the operation of filling the filling material can be carried out completely.

The filling material also functions as an anticorrosive material. Therefore, the joint of the prestressing strands can be protected over a long period of time.

Further, the filling material allows the wedges present in the prestressing strand coupler to properly bite into the prestressing strands in response to the prestressing strand tensioning operation performed after concrete placed around the coupler sheath has hardened and before the filling material hardens. Thus, a superior joint structure is provided.

What is claimed is:

1. A prestressing strand joint structure comprising:

a joint member having two ends and first screw portions disposed at outer surfaces of the two ends;

wedge portions for holding prestressing strands;

two chuck socket main bodies, each of said chuck socket main bodies having a tapered insertion hole for receiving the wedge portion and a second screw portion disposed at an inner surface at one end thereof for engaging one of the first screw portions of the joint member;

a transparent coupler sheath for covering the joint member and the chuck socket main bodies, said transparent coupler sheath having a resin filling material injection opening and discharge opening provided in a tube wall thereof; and a retarded-hardening resin filling material filled in said transparent coupler sheath.

2. A prestressing strand joint structure according to claim 1, wherein the resin filling material contains a retarded-hardening epoxy resin.

3. A prestressing strand joint structure according to claim 1, wherein the resin filling material is a greasy resin having low resistance to move when it is in an unhardened state.

4. A prestressing strand joint structure according to claim 2, wherein the resin filling material contains a retarded-hardening agent.

5. A prestressing strand joint structure according to claim 2, wherein the resin filling material contains a hardening accelerator.

6. A prestressing strand joint structure according to claim 1, wherein the prestressing strands are pregrouted cables.

7. A prestressing strand joint structure according to claim 1, wherein each of said wedge portions is formed of a plurality of pieces.

8. A prestressing strand joint structure according to claim 1, wherein said first screw portion at one of the two ends of the joint member has a thread in a direction opposite to that of the first screw portion at the other of the two ends of the joint member.

9. A prestressing strand joint structure according to claim 1, wherein said joint member further includes a holding portion at a middle thereof to be held when the joint member is rotated so that the first screw portions engage the second screw portions.

10. A method of constructing a prestressing strand joint, said method comprising the steps of:

joining pregrouted cables as prestressing strands with a joint;

covering the joint between the prestressing strands with a transparent coupler sheath having a resin filling material injection opening and discharge opening provided in a tube wall thereof;

injecting a resin filling material into said transparent coupler sheath from said injection opening to fill a space between said transparent coupler sheath and said joint with said resin filling material; and embedding a whole outer peripheral portion of the joint, including said coupler sheath, with concrete.

11. A method of constructing a prestressing strand joint, said method comprising the steps of:

covering a joint between prestressing strands with a transparent coupler sheath having a retarded-hardening resin filling material injection opening and discharge opening provided in a tube wall thereof, said joint being made with a prestressing strand coupler;

injecting a resin filling material into said transparent coupler sheath from said injection opening to fill said transparent coupler sheath with said resin filling material;

embedding & whole outer peripheral portion of the prestressing strand joint, including said coupler sheath, with placed concrete; and applying tension to the prestressing strands after the concrete has hardened and before the resin filling material hardens.

12. A method of constructing a prestressing strand joint according to claim 10, wherein the resin filling material contains a retarded-hardening epoxy resin.

13. A method of constructing a prestressing strand joint according to claim 12, wherein the resin filling material contains a retarded-hardening agent.

14. A method of constructing a prestressing strand joint according to claim 12, wherein the resin filling material contains a hardening accelerator.

* * * * *